US007331914B2

(12) United States Patent
Carlucci et al.

(10) Patent No.: US 7,331,914 B2
(45) Date of Patent: Feb. 19, 2008

(54) MUSCLE STRETCHING DEVICE AND METHOD FOR USING THE SAME

(75) Inventors: John Carlucci, Jackson, NJ (US); Rick Kocsis, Jackson, NJ (US); Mario Accumanno, East Hanover, NJ (US)

(73) Assignee: Delta Glide, L.L.C., Jackson, NJ (US)

( * ) Notice: Subject to any disclaimer, the term of this patent is extended or adjusted under 35 U.S.C. 154(b) by 352 days.

(21) Appl. No.: 10/934,063

(22) Filed: Sep. 2, 2004

(65) Prior Publication Data

US 2005/0124473 A1 Jun. 9, 2005

Related U.S. Application Data

(63) Continuation-in-part of application No. 10/730,313, filed on Dec. 4, 2003.

(51) Int. Cl.
*A63B 23/00* (2006.01)

(52) U.S. Cl. ..... 482/148; 482/140; 482/907

(58) Field of Classification Search ..... 482/142, 482/137, 72, 138, 130, 110–111; D21/676, D21/686, 690
See application file for complete search history.

(56) References Cited

U.S. PATENT DOCUMENTS

| | | | | |
|---|---|---|---|---|
| 182,957 | A | 10/1876 | Quigley | |
| 1,746,111 | A | 2/1930 | Fisher | |
| 2,720,396 | A | 10/1955 | Pfaus | |
| 2,783,045 | A | 2/1957 | Bosch | 272/81 |
| 3,966,200 | A | 6/1976 | Kirk | 272/109 |
| 4,492,376 | A | 1/1985 | Schatz | |
| 4,632,393 | A | 12/1986 | Van Noord | |
| 4,867,143 | A | 9/1989 | Morin | 128/75 |
| 4,930,769 | A | 6/1990 | Nenoff | 272/120 |
| 5,094,445 | A | 3/1992 | Winkelvoss | |
| 5,108,090 | A | 4/1992 | Reed | |
| 5,176,601 | A | 1/1993 | Reynolds | |
| 5,263,913 | A | 11/1993 | Boren | |
| 5,295,935 | A | 3/1994 | Wang | |
| 5,383,831 | A | 1/1995 | Drath | |
| 5,478,299 | A | 12/1995 | Harmon | |
| 5,649,886 | A | 7/1997 | Danylieko | |
| 5,776,037 | A | 7/1998 | Millington | 482/91 |
| 5,833,590 | A | 11/1998 | Chiu | |
| 5,957,955 | A | 9/1999 | Thomas | 606/243 |
| 6,030,325 | A | 2/2000 | Ottoson et al. | 482/144 |

(Continued)

OTHER PUBLICATIONS

Office Action dated Jul. 16, 2007 in U.S. Appl. No. 11/004,578, filed Dec. 3, 2004, first named inventor John Carlucci.

(Continued)

*Primary Examiner*—Lori Amerson
(74) *Attorney, Agent, or Firm*—Jeffer Mangels Butler & Marmaro LLP

(57) ABSTRACT

A device and method for stretching, toning and strengthening the chest, shoulder, neck and upper back muscles of a patient thereby relieving pain and improving posture. Typically the patient is suffering from tension related muscle problems. The device and method are used to facilitate therapeutic treatment of the muscle problems by progressively stretching the muscles and thereby relieving the muscle problems.

77 Claims, 13 Drawing Sheets

U.S. PATENT DOCUMENTS

| | | | | |
|---|---|---|---|---|
| 6,071,217 | A | 6/2000 | Barnett | |
| 6,196,954 | B1 | 3/2001 | Chen | |
| 6,220,995 | B1 | 4/2001 | Chen | |
| 6,220,996 | B1 | 4/2001 | McArthur | |
| 6,238,322 | B1 | 5/2001 | Hsu | |
| 6,245,000 | B1 | 6/2001 | Saakian et al. | 482/142 |
| 6,338,704 | B1 | 1/2002 | Endelman | |
| 6,371,895 | B1 | 4/2002 | Endelman et al. | |
| 6,416,447 | B1 | 7/2002 | Harmon | |
| 6,458,062 | B2 | 10/2002 | Conner | |
| 6,468,192 | B1 | 10/2002 | Doerscheln | 482/142 |
| 6,569,069 | B1 | 5/2003 | Linares | 482/148 |
| 6,592,501 | B1 | 7/2003 | Mayes | 482/142 |
| 7,086,992 | B2 | 8/2006 | Bowman | |
| 2004/0216929 | A1* | 11/2004 | White | 180/2.2 |

OTHER PUBLICATIONS

Preliminary Amendment filed on Jul. 3, 2007, in U.S. Appl. No. 10/730,313, filed Dec. 4, 2003, first named inventory John Carlucci.

* cited by examiner

MUSCLE STRETCHING DEVICE AND METHOD FOR USING THE SAME

RELATED APPLICATIONS

This application is a continuation-in-part of application Ser. No. 10/730,313, filed on Dec. 4, 2003.

FIELD OF THE INVENTION

The present invention relates generally to exercise equipment and methods, and more particularly, to equipment and methods for stretching muscles.

BACKGROUND OF THE INVENTION

The present invention is directed to the field of therapeutic equipment used to stretch and exercise certain muscle groups. In particular the device and method of the present invention is directed to treatment of persons who are suffering from stress related muscle problems in the neck, shoulders and upper back.

Persons who suffer from these stress related problems typically appear to walk or stand in a slumped forward position which results in short and tight chest muscles. Further, their shoulder muscles are sagging and the upper back muscles between the shoulder blades are long, atrophied and very sore. When the head is carried forward, the muscles in the upper back and lower neck are significantly strained just keeping the head erect. This medical condition is known as "anterior translation" and is the single largest cause of upper back and neck pain as well as tension headaches in the skull. Typically, these conditions result in spinal misalignment of the neck and upper back. The spinal misalignment problems usually start early in life and progress to more serious conditions such as disc problems and hump back.

In the past, one of the therapies for the aforementioned problems has been various exercises intended to stretch the muscles without the use of any device to facilitate the exercise. However, patients performing such exercises have generally been unable to precisely and consistently repeat the particular motions associated with the exercises, resulting in a diminished therapeutic effect. The device and method of the present invention is adapted to facilitate and improve upon the muscle stretching exercises which relieves the problems mentioned above.

SUMMARY OF THE PREFERRED EMBODIMENTS

The present invention is directed to a platform comprising a device for stretching the muscles in the chest, shoulder, neck and upper back to relieve tension related muscles problems. The device comprises a generally flat longitudinally extending area comprising a top surface and a bottom surface wherein preferably the top surface is padded for a user's comfort, a plurality of legs attached to the bottom surface of the platform for positioning the device at an angle to a horizontal surface and a rotating handle bar slidingly attached to the bottom of the platform and adapted to allow the user to stretch his or her muscles through sliding movement of the bar in a direction generally parallel to the top of the platform.

The present invention is also directed to providing a method for stretching chest, shoulder, neck and upper back muscles of a patient to relieve tension related muscle problems. The method comprises providing a device comprising a platform comprising a generally flat longitudinally extending area comprising a top surface and a bottom surface wherein the top surface is padded for the patient's comfort, a plurality of legs attached to the bottom surface of the platform for positioning the device at an angle to a horizontal surface and a rotating handle bar slidingly attached to the bottom of the platform and adapted to allow the patient to stretch his or her muscles through sliding movement of the bar in a direction generally parallel to the top of the platform, positioning the patient on the platform of the device, engaging the patient in stretching exercises by setting the rotating handle bar to a position relative to the top of the platform and directing the patient to slidingly move the rotating handle bar a plurality of times to stretch out muscles.

In accordance with another aspect of the present invention, a muscle stretching device comprising a platform assembly, a base assembly and a handlebar assembly connected to the platform assembly is provided. The platform assembly preferably comprises a first section, a second section and a concave transition between the first and second sections. In preferred embodiments, the platform assembly has a compact position and an expanded position.

In accordance with yet another aspect of the present invention, a muscle stretching device is provided which comprises a base assembly mounted to a platform and a handlebar assembly. The handlebar assembly is preferably adapted for sliding movement with respect to the platform in a direction parallel to a plane defined by a surface of the platform. In preferred embodiments, the handlebar assembly comprises a handlebar that is adapted to rotate with respect to the plane. In additional preferred embodiments, the handlebar is adapted to rotate to a plurality of pre-selected positions with respect to the plane, more preferably, three preselected positions. In other preferred embodiments, the handlebar is adapted to rotate above and below the platform plane.

In accordance with still another aspect of the present invention, a muscle stretching device comprising a platform assembly, a handlebar assembly, and a guide assembly is provided. The platform assembly comprises a platform mounted to a base assembly. The guide assembly is attached to the platform and includes a frame having a pair of sidewalls. At least one roller assembly is attached to each sidewall. The handlebar assembly comprises a sliding engagement member connected to a handlebar, and the sliding engagement member slidingly engages the guide assembly. In a preferred embodiment, the guide assembly is attached to the lower surface of the platform. In other preferred embodiments, the sliding engagement member slidingly engages the guide assembly between the roller assembly and the lower surface of the platform. In still other preferred embodiments, three roller assemblies are provided.

In accordance with further aspects of the present invention, a method of stretching the muscles for use by a person is provided. According to the method, a platform assembly comprising a platform mounted to a base assembly is provided. The platform has surface that defines a plane. A handlebar assembly is provided which comprises a handlebar adapted for sliding movement with respect to the platform in a direction parallel to the platform plane. To perform the method, the person lies on the platform, grips the handlebar, and extends the handlebar away from the platform in a direction parallel to the plane.

In a preferred embodiment, the person rotates the handlebar to a pre-selected position with respect to the plane before extending it. In accordance with other preferred embodiments, the position is about 10 degrees below the plane. In further preferred embodiments, the position is about 40 degrees above the plane, in still other preferred embodiments, the position is about 90 degrees above the plane. In still other preferred embodiments, the platform comprises a first section, a second section, and a concave transition between the first and second sections and the person extends the handlebar such that her shoulders extend beneath the top surface of the platform. In yet additional preferred embodiments, the handlebar defines a plurality of fixed handlebar locations, and the user grips the handlebar at one of those fixed locations. It is particularly preferred that the person repeat the extension step while gripping three different fixed locations

BRIEF DESCRIPTION OF THE DRAWINGS

The invention may be more readily understood by referring to the accompanying drawings in which.

Like numerals refer to like parts throughout the several views of the drawings.

DETAILED DESCRIPTION OF THE PREFERRED EMBODIMENTS

Figure 1:
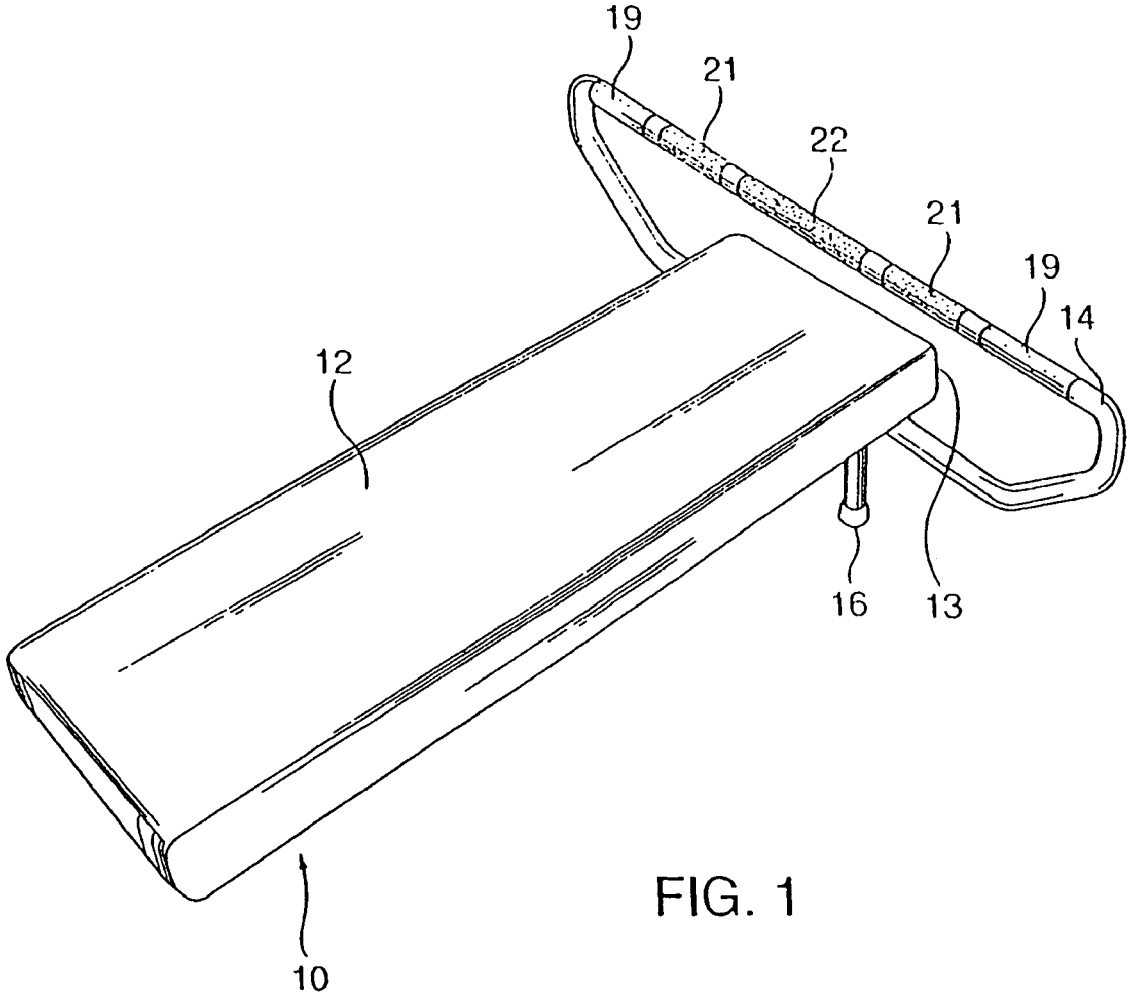
FIG. 1 is a perspective view of a first embodiment of the present invention.
Figure 2:
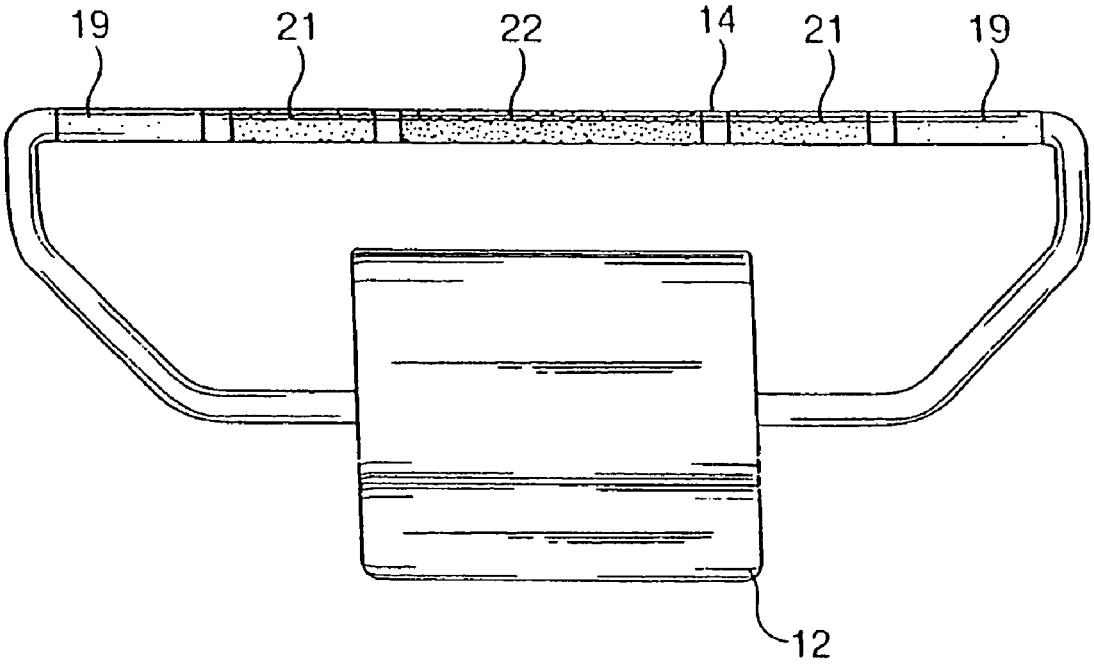
FIG. 2 is a rear elevational view thereof.

The present invention will now be described in the context of its presently preferred embodiment as illustrated in the drawings. Those of ordinary skill in the art will recognize that many obvious modifications may be made thereto with departing from the spirit or scope of the invention as set forth in the appended claims.

Referring to FIGS. 1-9, in accordance with a first preferred embodiment of the present invention, exercise device 10 comprises a platform 12 on which a user of the device will lay. The platform 12 is padded and covered with a vinyl material for the comfort of the users. A rotating handle bar 14 is slidingly connected to the bottom of the platform 12 at its top end 13. The device 10 further comprises a plurality of legs 16. The legs 16 are fixed to the bottom of platform 12 in a conventional manner near its top end 13. The legs 16 are sized to provide the proper angle to the horizontal for the stretching exercises described below.

Figure 3:
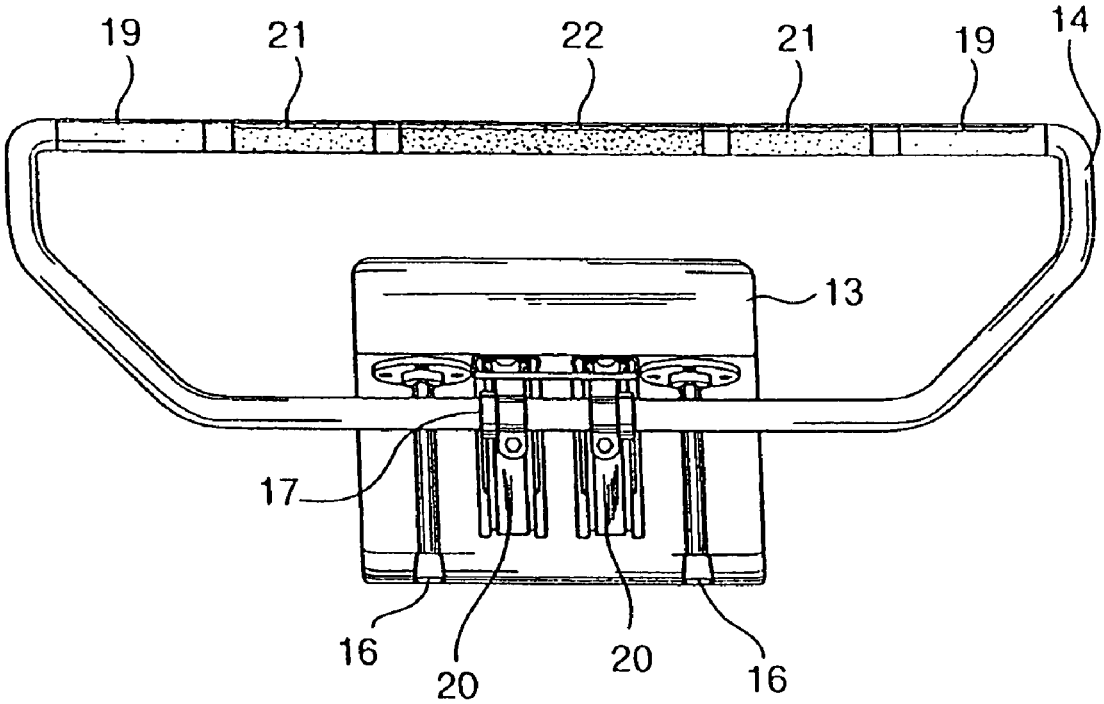
FIG. 3 is a front elevational view thereof.
Figure 4:
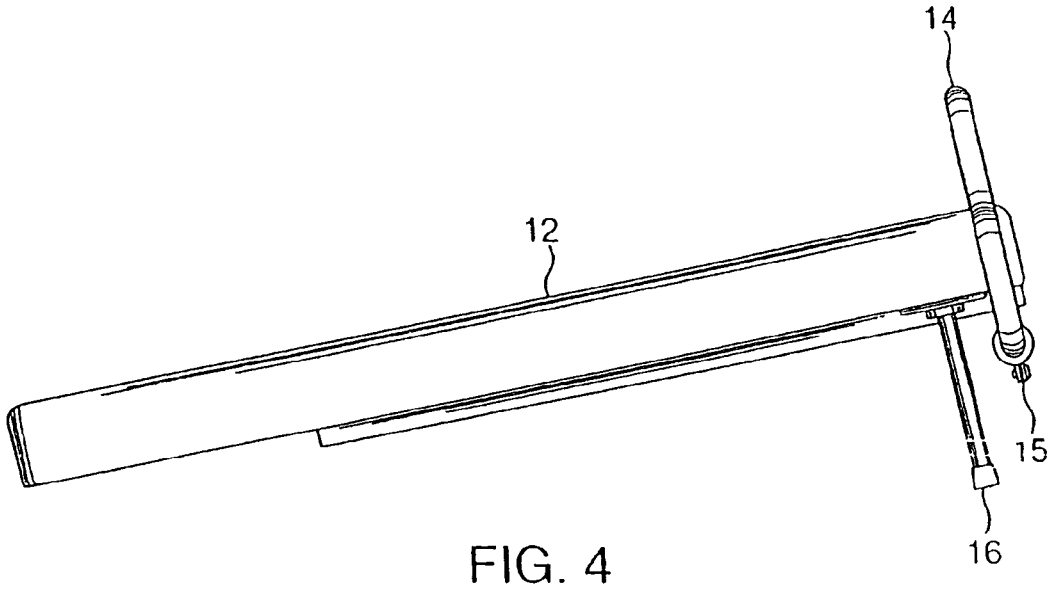
FIG. 4 is a right-side elevational view thereof.
Figure 5:
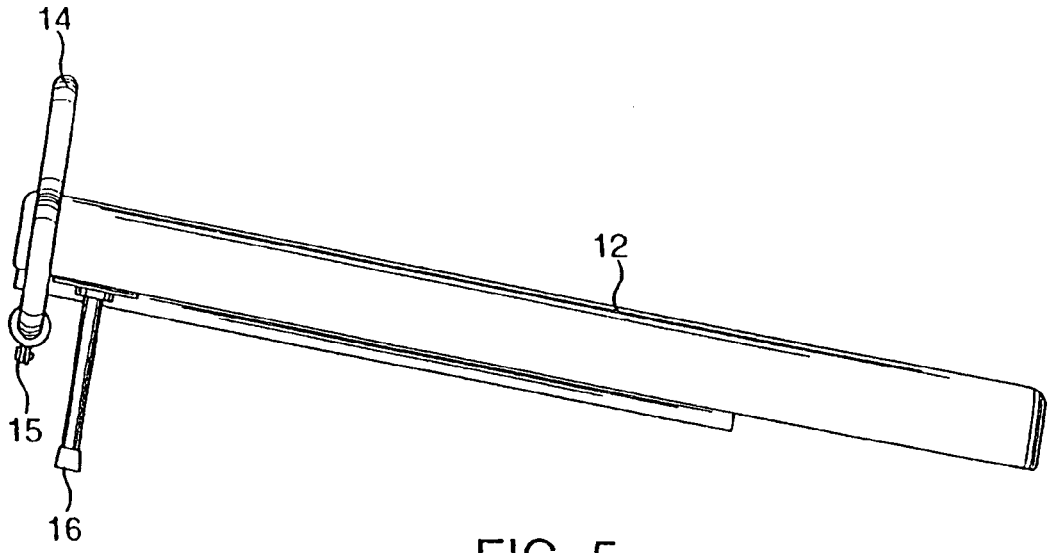
FIG. 5 is a left-side elevational view thereof.
Figure 6:
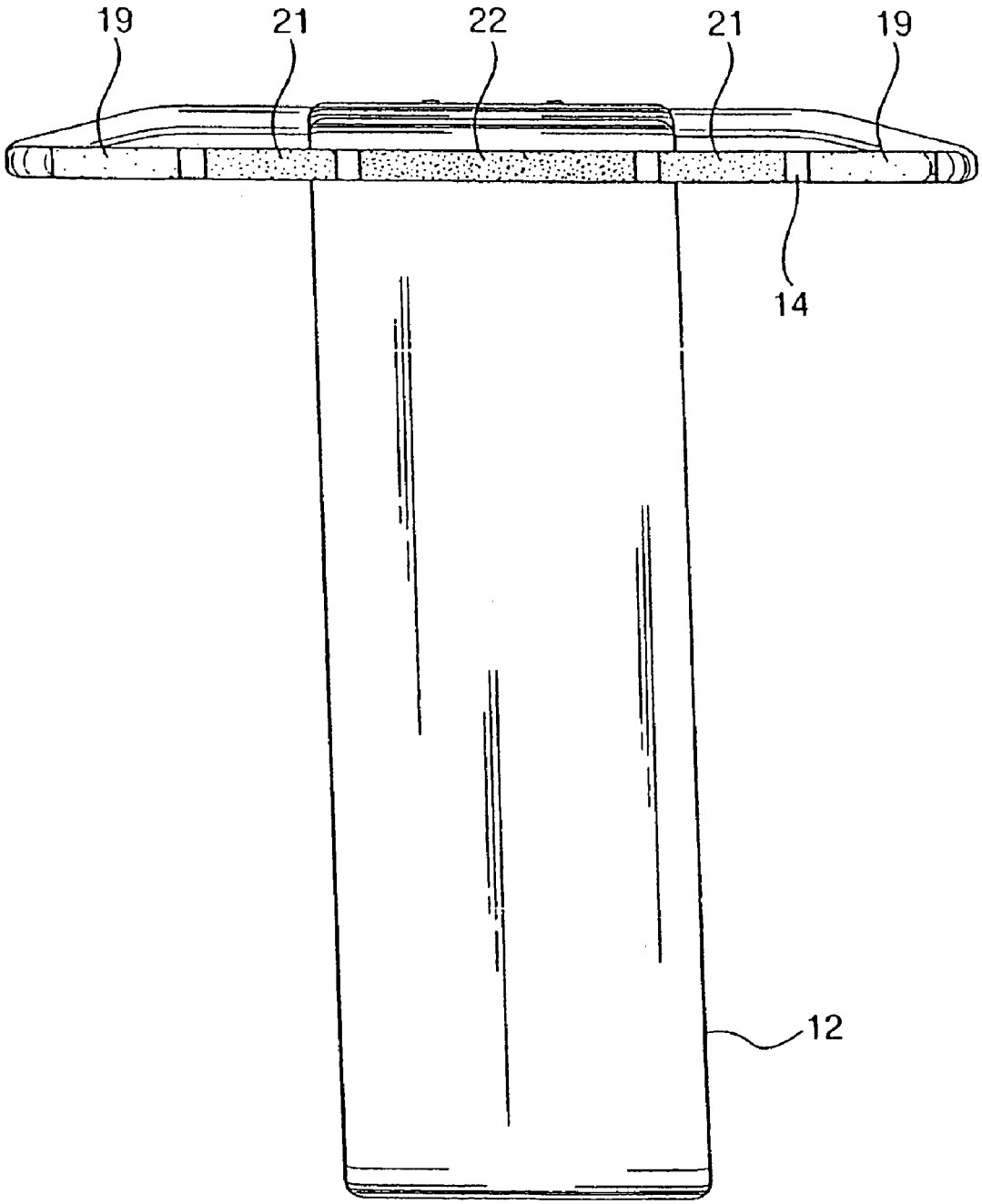
FIG. 6 is a top plan view thereof.
Figure 7:
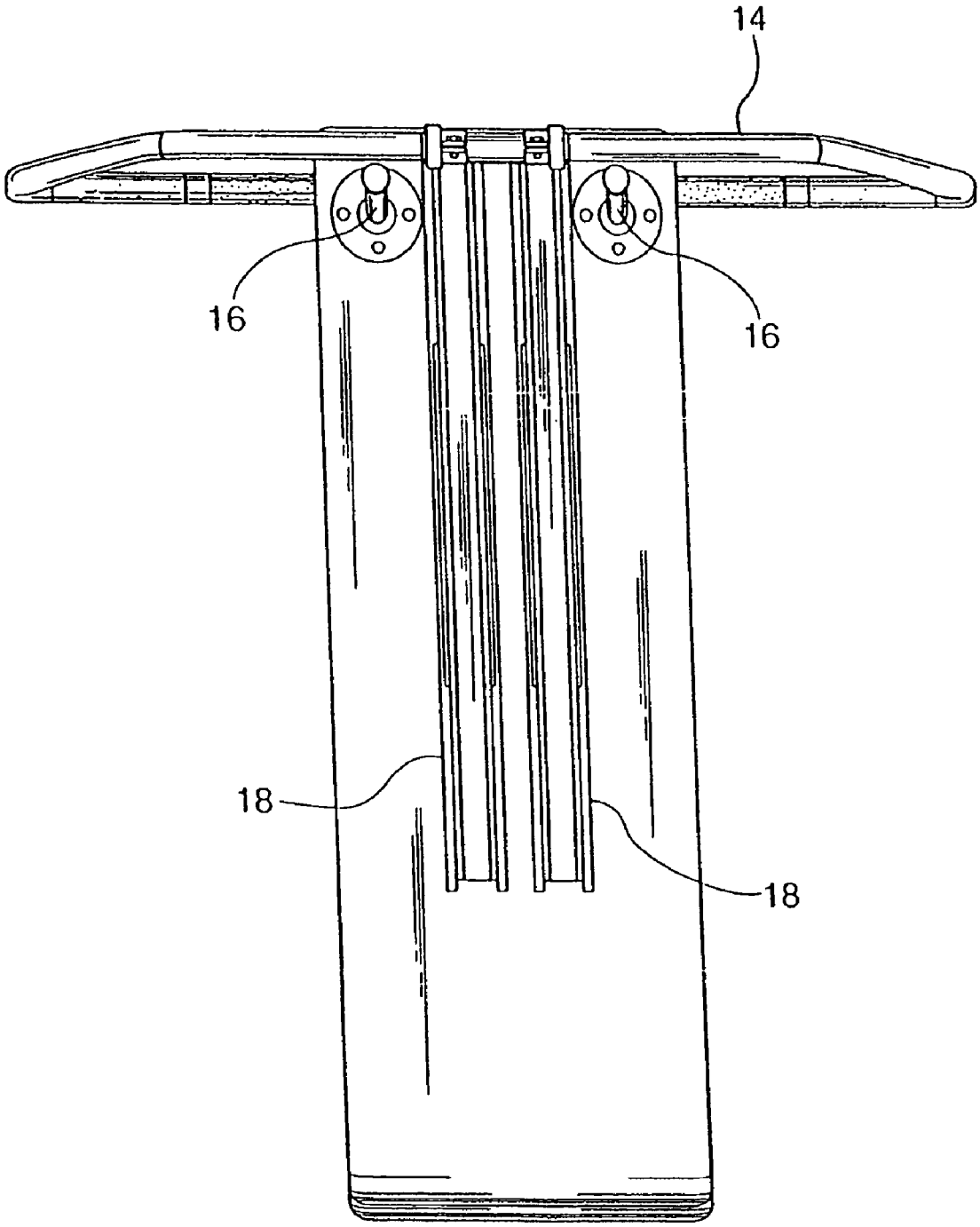
FIG. 7 is a bottom plan view thereof.

As illustrated in FIG. 7, the bottom of platform 12 is provided with a first set of elongated tracks 18. As shown in FIG. 3, the rotating handle bar 14 is connected to a second set of elongated metal tracks 20. The tracks 20 are adapted to be slidingly received in tracks 18. As described below, when the user moves the bar 14, the tracks 20 will be extended in a longitudinal direction into and out of tracks 18.

A ring pin 15 on the rotating handle bar 14 allows the user to rotate the handle bar 14 to different positions with respect to the top of the platform 12. As explained below, changing the angle of the rotating handle bar 14 with respect to the platform 12 allows the user to set the difficulty level for the stretching exercises.

The method of using the device 10 will now be described. First, the user sets the rotating handle bar 14 to the position with respect to platform 12 that provides the easiest movement. This is accomplished by removing the ring pin 15, turning the bar 14 to a first mark 17, and reinserting the ring pin 15.

Figure 8:
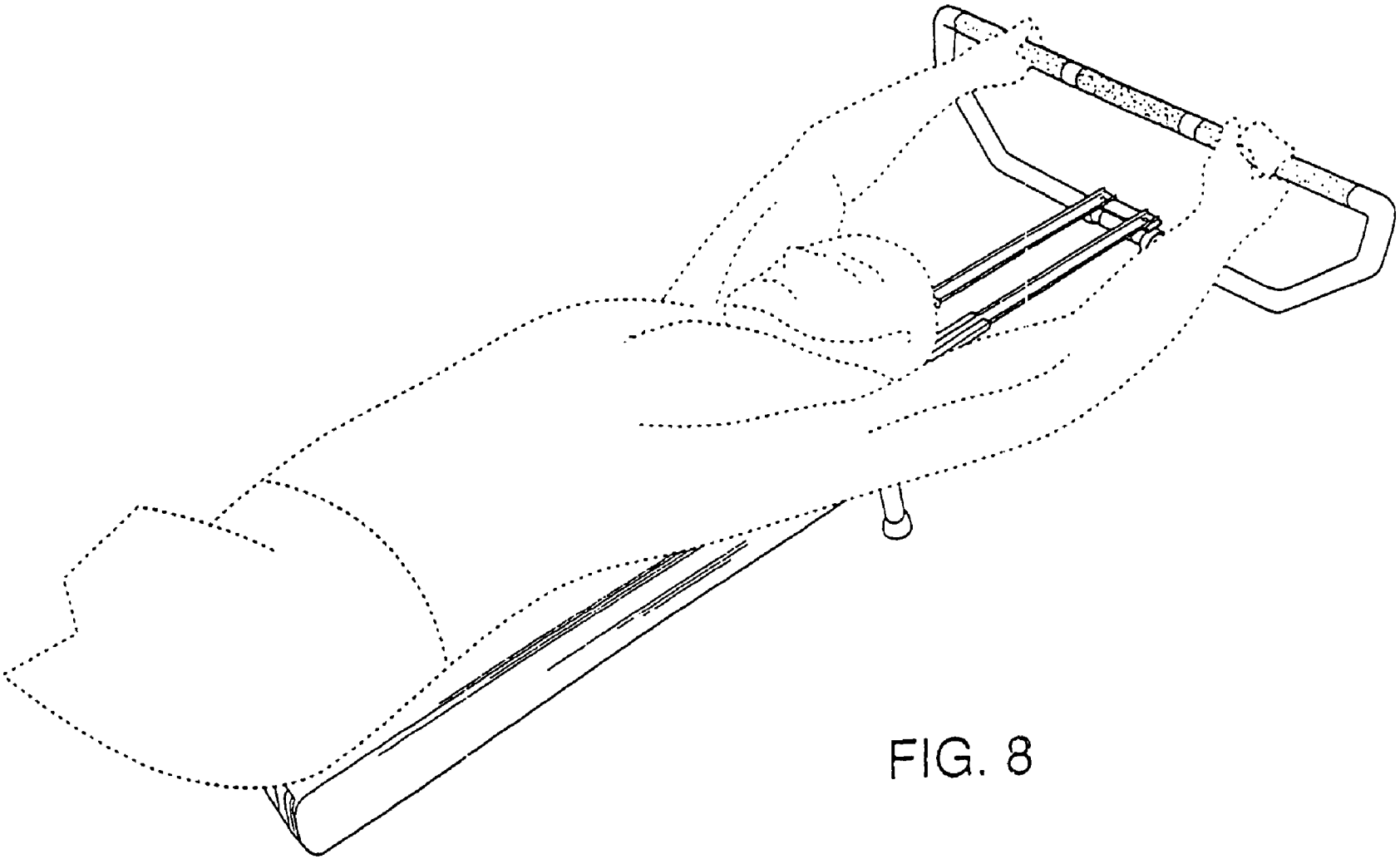
FIG. 8 is a perspective view thereof.

As partially illustrated in FIG. 8, the user lies on the platform 12 on her back with her head at the top end 13 of the platform 12. She flexes her knees to the chest and positions the feet directly under her buttocks. The user then does three stretches each of which is progressively more strenuous. The stretches target the muscle groups from the outer edge of the body to progressively closer to the midline of the spine. For the easiest stretch, the user places her or his hands on outer stripes 19 on rotating handle bar 14. She extends the arms above the head and then repeats the exercise and thereby extends rotating handle bar 14 by means of the tracks 20 extending out of the tracks 18. The user then locks the elbows, slowly counts to about 60 or more, and then retracts the bar 14 into the original position.

This position—with the hands on the outer stripes 19—stretches and tones the muscles of the chest as well as the muscles along the outer sides of the body which including the chest, trunk and arms. Next, she places her hands on middle stripes 21 and repeats the same exercise. This stretches and tones the muscle groups between the outer edge of the body and midline of the spine including the muscle around the shoulder blades and shoulder joints. Finally, the user places both hands on inner stripe 22. This stretches the key muscle groups along the spine itself including those in the mid and upper back, the lower neck, and across the traps.

The user is able to completely stretch and tone all of the joints and muscle groups across the chest, in the shoulders and rotator cuff, the traps and upper shoulders, the lower neck, the upper and mid back, as well as the key groups between the shoulder blades in a relatively short period of time. Thus, the key muscle groups that cause stress, back pain, neck pain, and tension headaches are stretched out. Consequently, the user's stress related symptoms will be lessened and/or preferably alleviated through repetition of these exercises.

Once the user is comfortable using the device 10 of the present invention in the easiest setting, she or he can set the handle bar 14 through the adjustment of the ring pin 15 to a setting which causes more stretching by rotating bar 14 further from the top of platform 12. The increased setting puts more external rotation into the shoulder girdle which dramatically increases the stretch benefit when extending overhead. After the user is comfortable with an increase, she or he can progress to a more advanced setting by rotating the bar 14 further from the top of platform 12. This is the most challenging and therapeutic of all.

Figure 9:
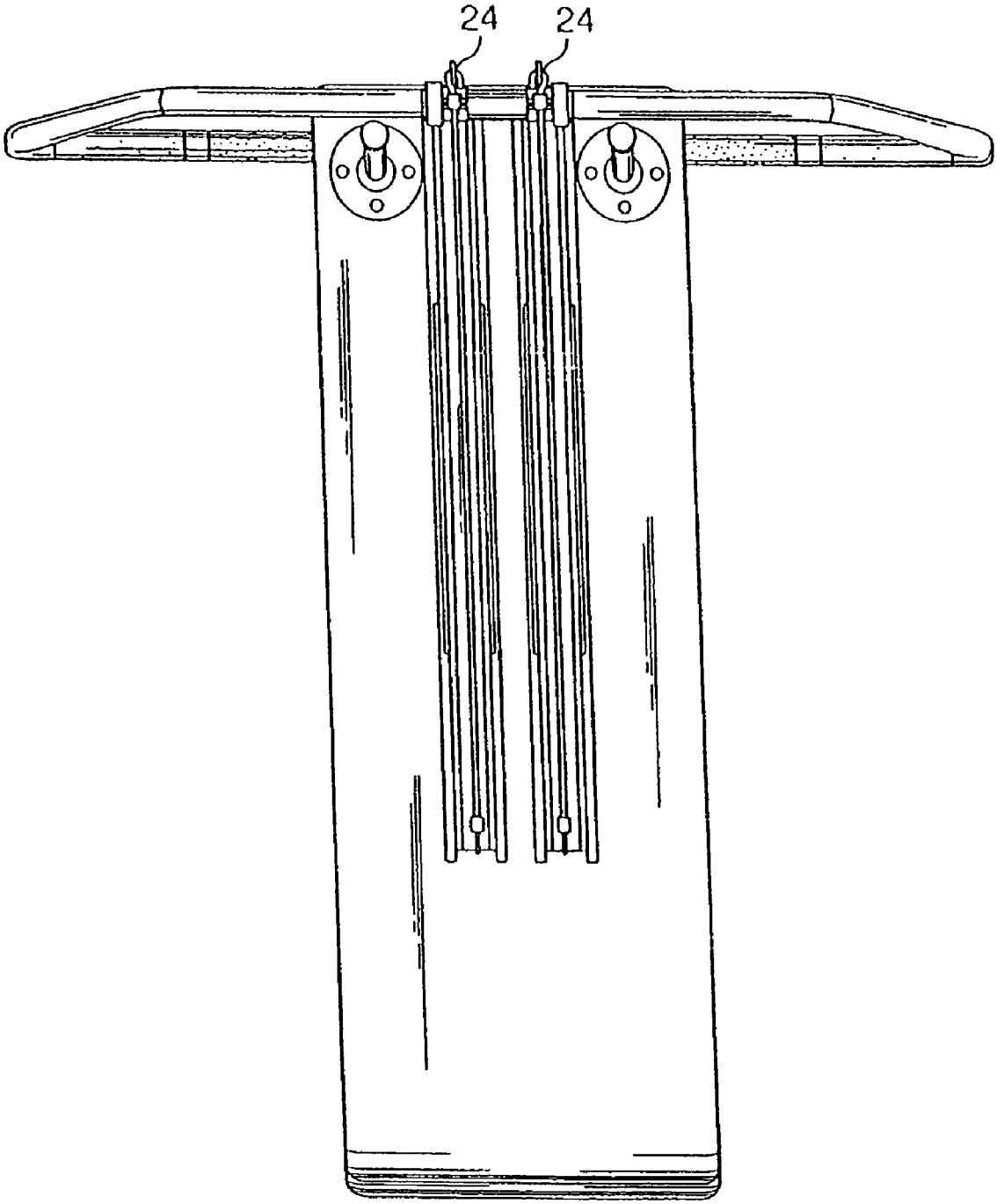
FIG. 9 is a bottom view thereof.

When the user has reached the point of maximum stretch and flexibility, which will be different for everyone, she or he can gain more benefit by adding resistance to the regimen described above. Resistance adds the benefits of increased muscle tone, stamina, and strength. As illustrated in FIG. 9, resistance is added by attaching a stretchable band 24 between the rotating bar 14 and the bottom of the platform 12. After the resistance is added, the same exercises as described above are repeated. More bands or stronger bands may be added to further increase resistance. The resistance bands take the user to a new level by giving strength and endurance, as well as flexibility.

Figure 10:
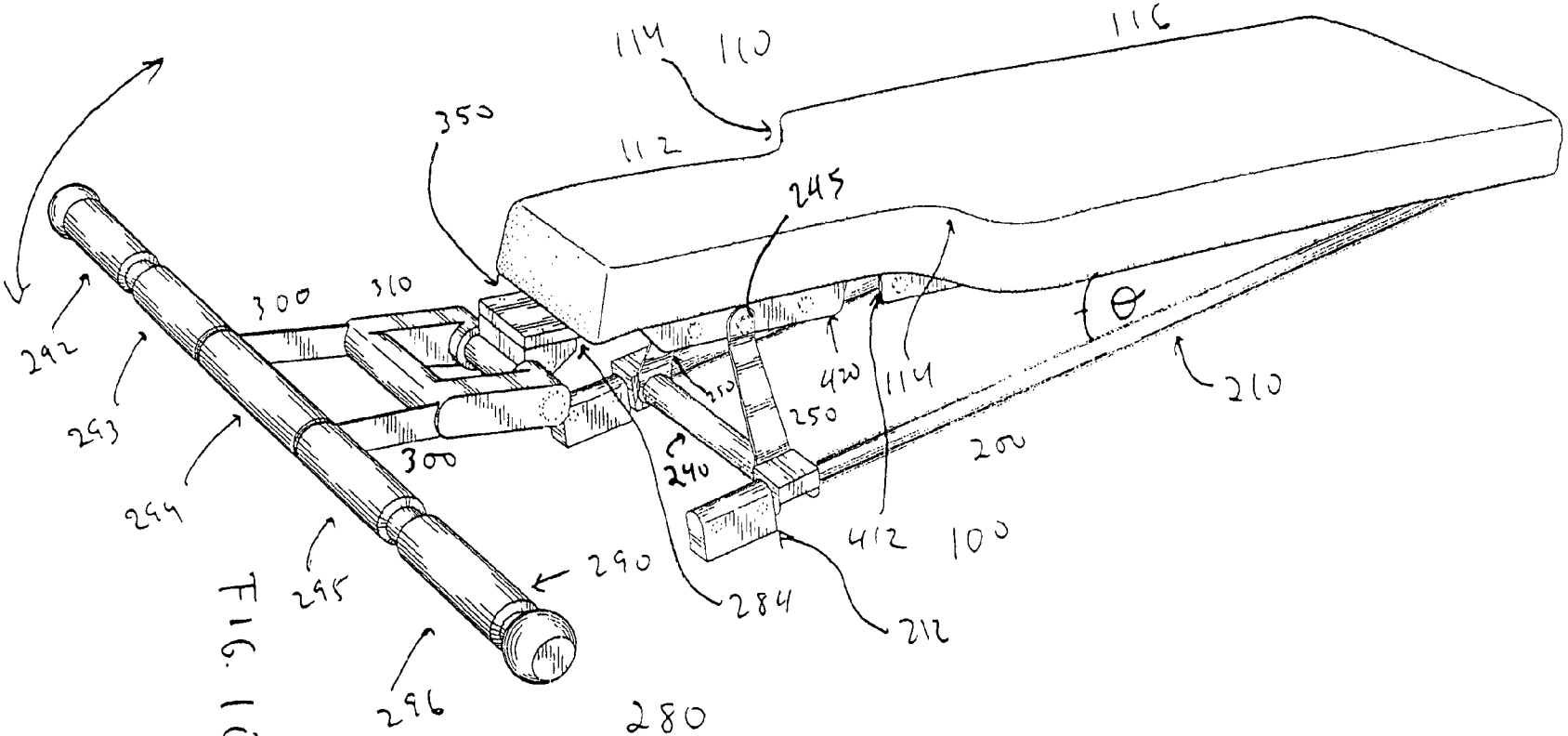
FIG. 10 is a perspective view of a second embodiment of the present invention.

A muscle stretching device in accordance with a second preferred embodiment is depicted generally in FIG. 10. As shown in the Figure, the device of this embodiment comprises a platform assembly 100 comprising a platform 110, a base assembly 200, and a handlebar assembly 280.

Figure 10A:
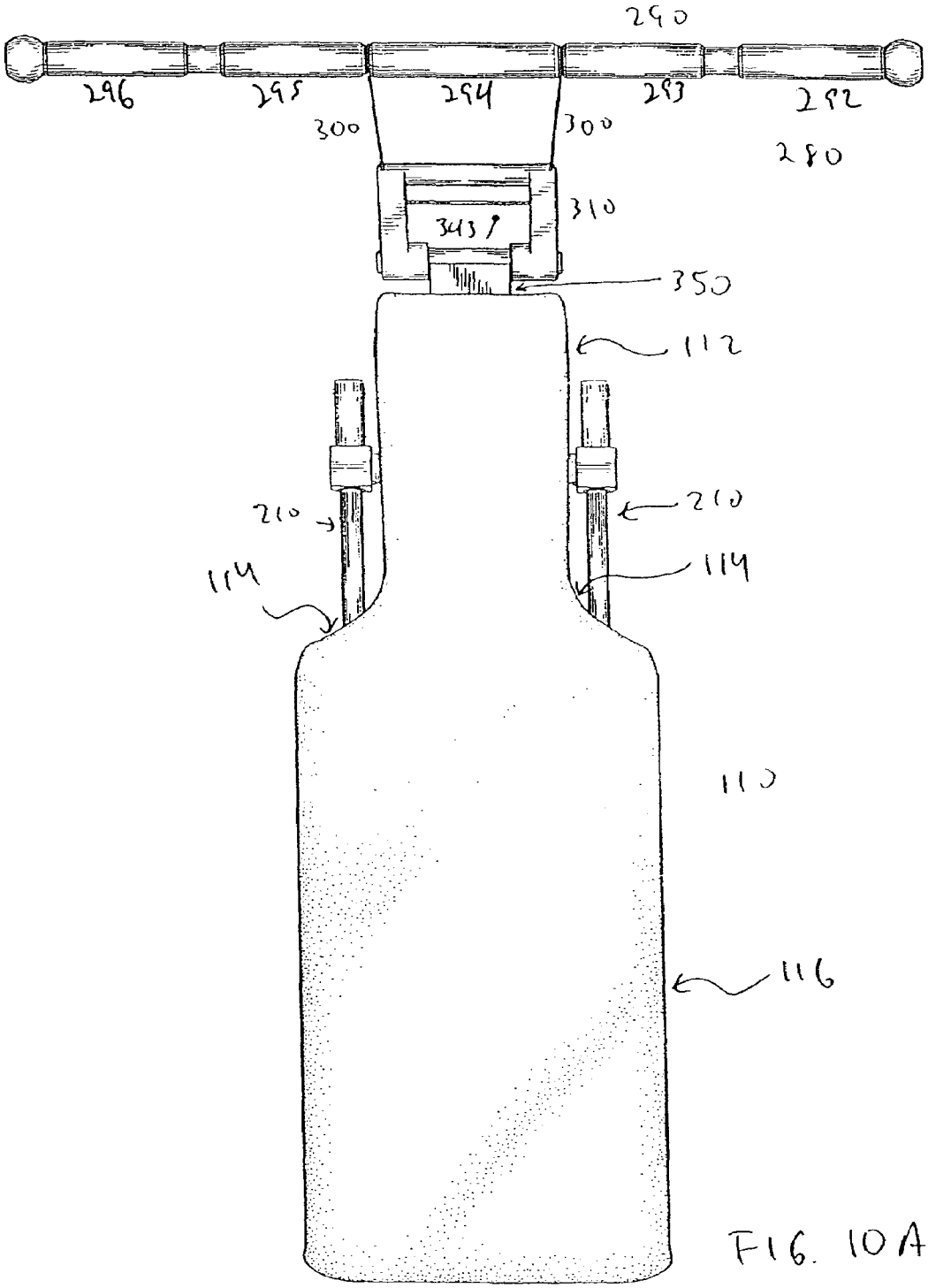
FIG. 10*a* is a top plan view thereof.

Platform 110 preferably includes a padded material and a vinyl covering for user comfort. Platform 110 includes a first section 112 where the user places his head and a second section 116, where the user places his torso and legs. Concave transition 114 connects first section 112 and second section 116. Concave transition 114 is best seen in FIG. 10A, which is a top plan view of the exercise device of the second embodiment. As FIG. 10A indicates, first section 112 comprises straight side portions of platform 110 as does second section 116. As shown in FIG. 10A, first section 112 is generally wider than second section 116. Concave transition 114 comprises two concave side portions of platform 110, each of which connect the first section 112 and second section 116 on each side of platform 110. In use, the user places his shoulders at concave transition 114, such that they roll back and dip below the top surface of platform 110 when extending handlebar 290 away from platform 110. The ability to roll back and dip the shoulders in this manner provides a more therapeutically effective stretch. However, concave transition 114 can have a number of different specific curvatures that provide this functionality.

Figure 11:
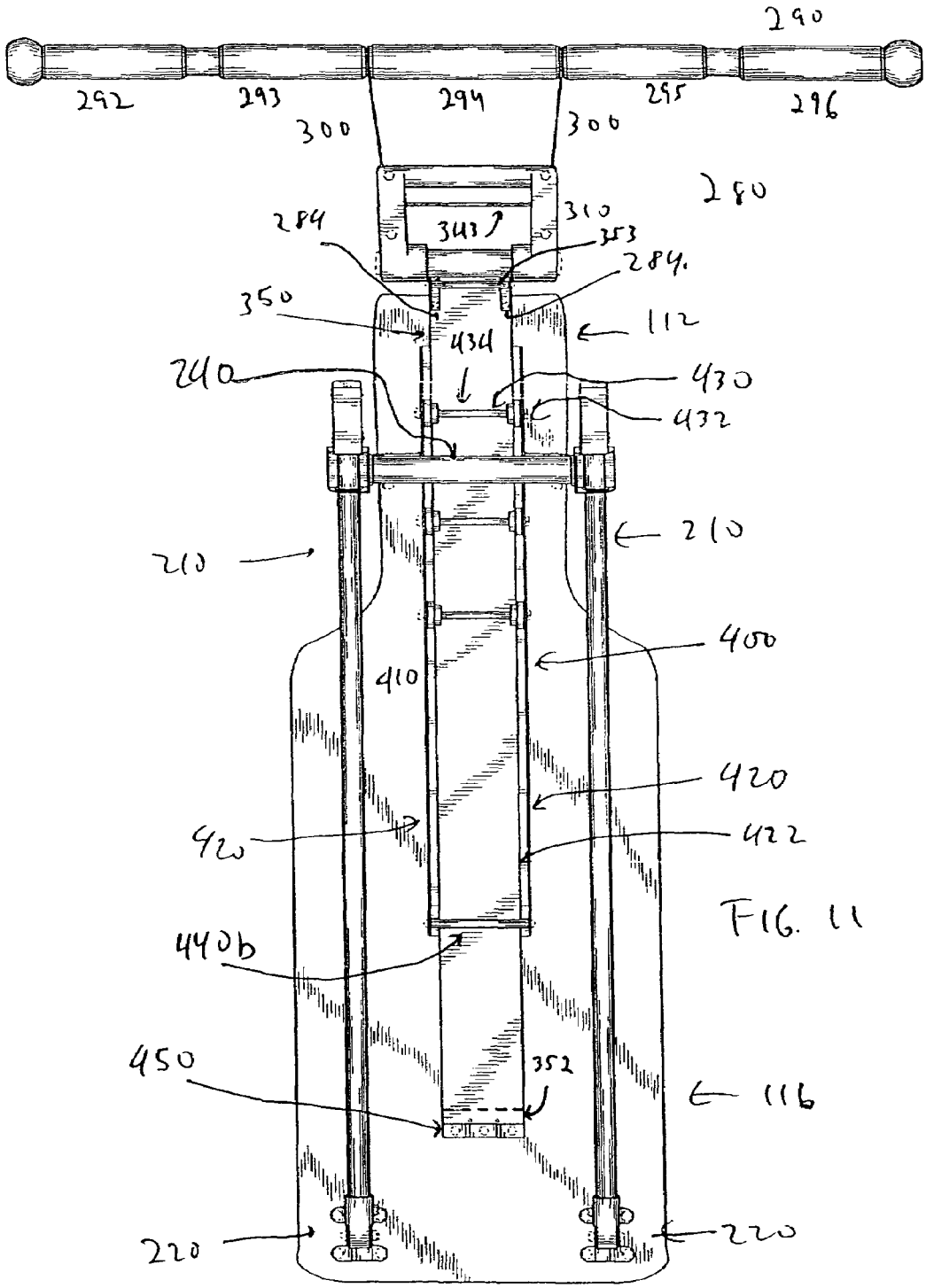
FIG. 11 is a bottom plan view thereof.

Base assembly 200 is collapsible and comprises two legs 210, which are attached at an end of platform 110 near second section 116 and away from handlebar assembly 280. Legs 210 are connected by cross-member 240. As best seen in FIG. 11, legs 210 are pivotally connected to the lower surface of platform 110 by a bracket assembly 220. The pivotal connection allows legs 210 to open and close, enabling the user to collapse the device for ease of storage.

Handlebar assembly 280 comprises a handlebar 290 attached to a pair of handle brackets 300. Handle brackets 300 are connected to a handlebar housing 310 which is adapted to rotate to a plurality of preselected positions, as will be described in greater detail below. Handlebar assembly 280 also includes a sliding engagement member 350, preferably a rectangular metal glide, which allows the user to slide handlebar 290 away from platform 110 in a direction parallel to the surface of platform 110. Sliding engagement member 350 has upper and lower surfaces. The upper surface (not shown) is preferably smooth. However, the lower surface can be smooth, as in FIG. 11, or corrugated, as in FIG. 12.

As best seen in FIG. 11, the device of the second embodiment includes a guide assembly 400 which cooperates with sliding engagement member 350 to enable handlebar 290 to slidably move with respect to platform 110. Guide assembly 400 comprises a frame 410 having a pair of sidewalls 420. In the embodiment of FIG. 11, the sidewalls 420 are connected by an integral flat portion 422 that is secured to the lower surface of platform 110 by suitable fasteners. A plurality of roller assemblies 430 are connected to each side wall. Each roller assembly comprises two rollers 432 connected by a roller shaft 434. Rollers 432 are spaced apart from integral flat portion 422 and rotate freely within frame 410.

Sliding engagement member 350 is disposed within frame 410 such that its lower surface rests on rollers 432 beneath the integral flat portion 422 and the lower surface of platform 110. The engagement of sliding engagement member 350 with rollers 432 enables the handlebar assembly 280 to slide in and out of frame 410, and thereby slideably move with respect to platform 110. Thus, handlebar 290 can be extended from platform 110 in a controlled manner, as it is restrained by the sliding engagement member 350 and roller assemblies 430 such that it can only move in a direction that is parallel to platform 110.

Figure 13:
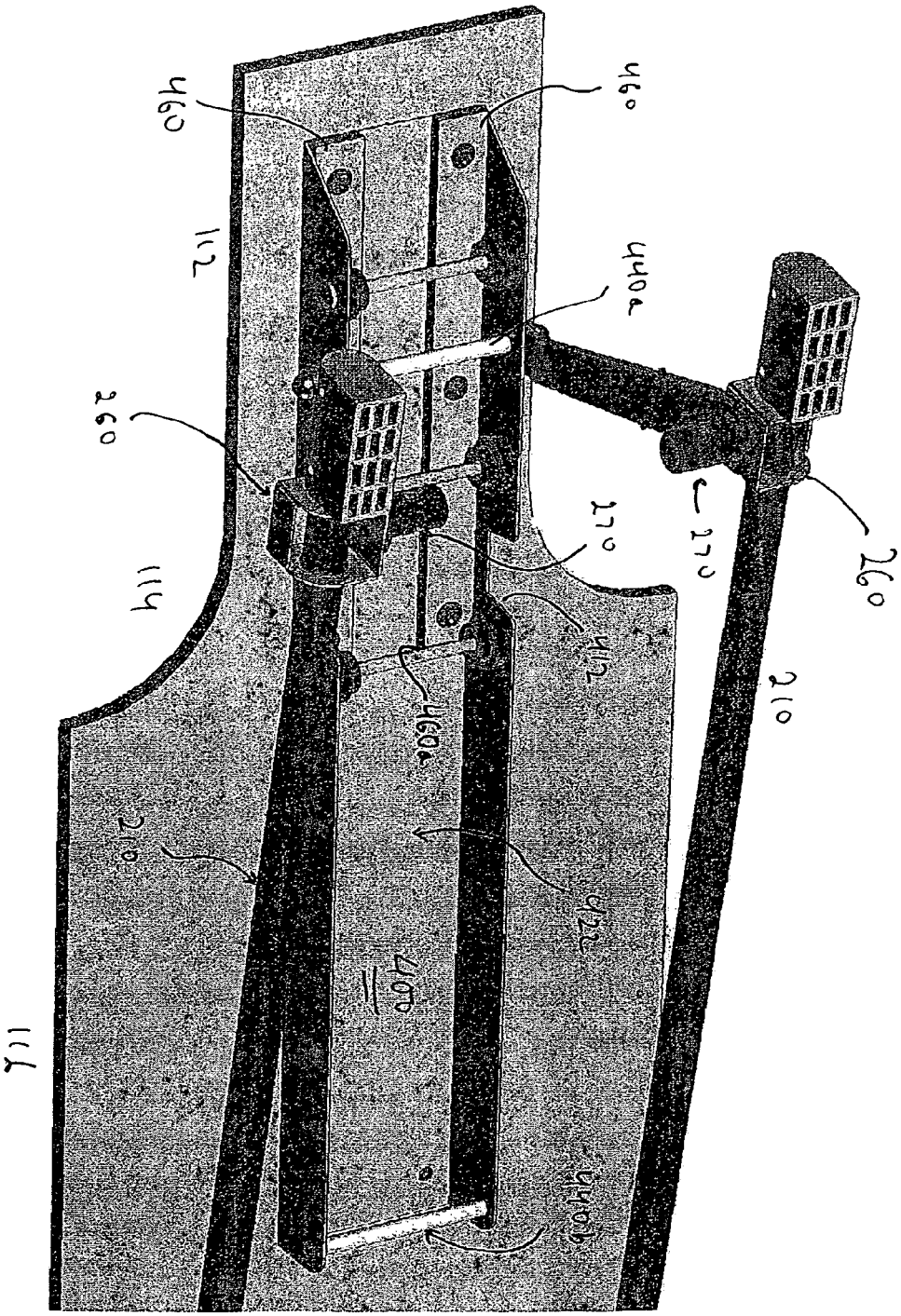
FIG. 13 is a detail view of the second embodiment of the present invention.

FIG. 13 depicts the device of the second embodiment with the handlebar assembly 280 and cross-member 240 removed. As shown in the figure, the device of the second embodiment further comprises a handlebar extension restraint 460 for restraining the movement of handlebar assembly 280 as the user slides it away from platform 110. Handlebar extension restraint 460 prevents the user from sliding handlebar assembly 280 entirely out of guide assembly 400. Preferably, handlebar extension restraint 460 comprises two rectangular blocks secured to integral flat portion 422 and the lower surface of platform 110 by suitable fasteners such as t-nuts. Handlebar restraint 460 has two faces 460*a* (one of which is shown) which are used to abuttingly restrain the movement of sliding engagement member 350. A variety of materials can be used for the handlebar restraint, however, an acetyl copolymer such as DELRIN®, a registered trademark of DuPont Corporation, is especially preferred.

Figure 14:
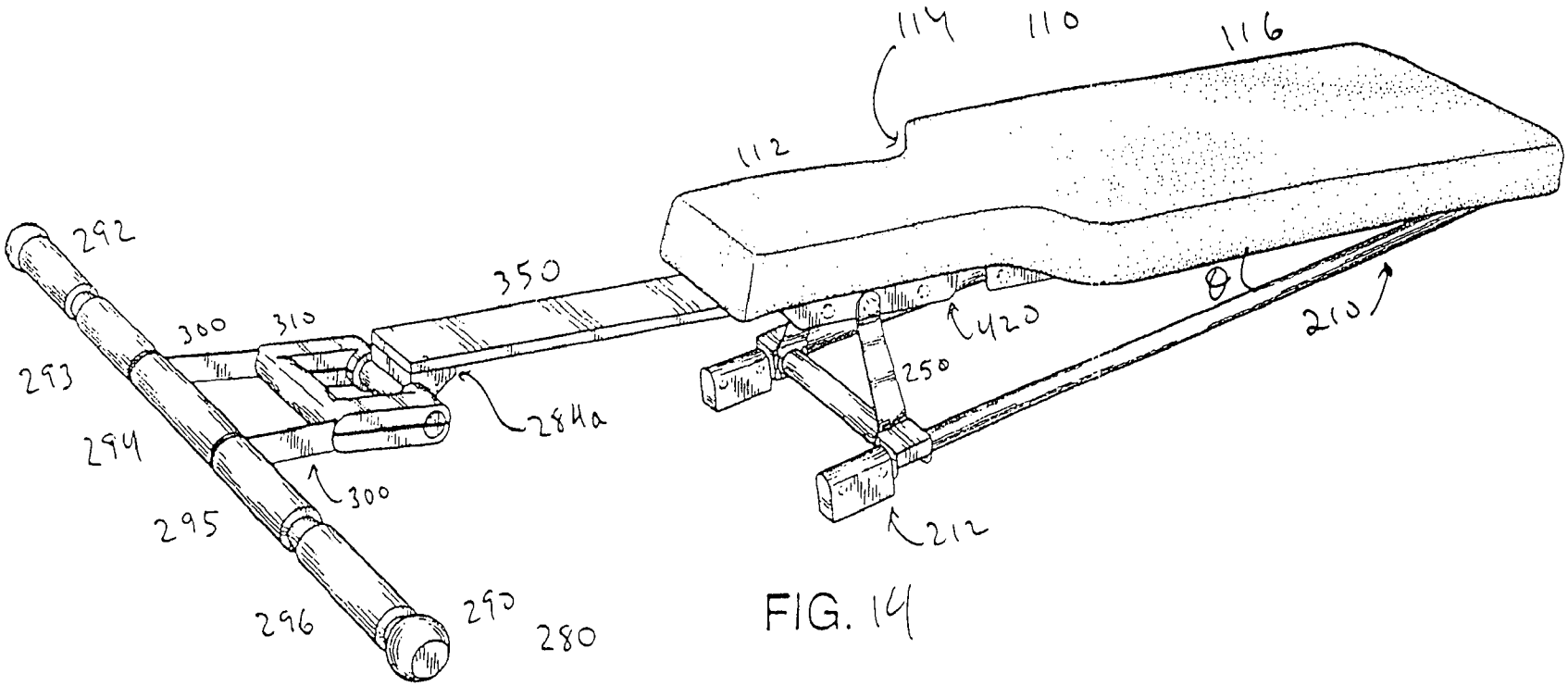
FIG. 14 is a view of the second embodiment of the present invention with the handlebar assembly fully extended.

To prevent it from being pulled out of guide assembly 400, sliding engagement member 350 includes an extension restraining piece 352 on its free end away from handlebar assembly 280. Preferably, restraining piece 352 is a rectangular block of DELRIN®, secured at the end of sliding engagement member 350 and facing towards the lower surface of platform 110. Restraining piece 352 and handlebar extension restraint 460 are preferably of sufficient thickness that when the user slides handlebar assembly 280 away from platform 110, restraining piece 352 will eventually abut handlebar restraint 460 at face 460*a*, thereby preventing further movement of handlebar assembly 280 away from platform 110. At this point, handlebar assembly 280 is fully extended from platform 110, as depicted in FIG. 14. In like fashion, handlebar retraction restraint 450 is attached to lower surface of platform 110 away from handlebar assembly 280. Retraction restraint is preferably a rectangular block of DELRIN®. Restraining piece 352 and retraction restraint 450 are preferably of sufficient thickness that when the user retracts handlebar assembly 280, restraining piece 352 abuts against retraction restraint 450, thereby preventing further retraction. At this point, handlebar assembly 280 is in its fully retracted position.

According to the second embodiment, the exercise device is collapsible. To provide collapsibility, base assembly 200 includes a pair of arms 250, each of which is pivotally connected at one end to frame 410 of guide assembly 400 located on the lower surface of the platform 110. Any known connector which provides a pivotal connection between arms 250 and frame 410 can be used, such as bolts 245. Arms 250 are also connected to bearing carrier 260 via nipples 270, as shown in FIGS. 10 and 13. Arms 250 include an aperture designed to accommodate nipples 270 attached to bearing carriers 260. Arms 250 are thereby able to rotate about nipples 270. Each leg 210 of base assembly 200 is inserted through a corresponding bearing carrier 260, such that each bearing carrier 260 can slide along its corresponding leg 210. Each nipple 270 is secured within a corresponding end of cross-member 240 by a known connector, such as a nut and bolt or a clevis pin and retainer. The free end of each leg 210 is also provided with a foot 212 which restrains the movement of bearing carrier 260.

As a result of the foregoing configuration, when the user pushes cross-member 240 away from handlebar assembly 280, bearing carriers 260 slide along their respective legs 210 in the same direction. As a result, arms 250 rotate away from handlebar assembly 280 and eventually abut the lower surface of platform. Frame 410 includes notch 412 which is sized to accommodate cross-member 240. Once arms 250 have fully rotated away from handlebar assembly 280, cross-member 240 is positioned within notch 412, at which point the device is in its compact position and ready for storage.

When in use, platform 110 is preferably angled with respect to the legs 210 and the surface on which the device is placed such that the first section 112 is elevated above second section 116. A variety of angles (θ) between platform 110 and legs 210 can be used. An angle of 0 to 20 degrees is preferred. An angle of 5 to 15 degrees is especially preferred and an angle of 10 degrees is most preferred. The angle is also preferably adjustable between angles of 0 to 20 degrees, and more preferably between 0 and 15 degrees, with an adjustable angle of 0 to 10 degrees being especially preferred.

As mentioned previously, the device of the second embodiment is designed to enable the user to rotate handlebar 290 to several pre-selected positions with respect to the plane defined by the lower surface of platform 110. An exploded view of a preferred embodiment of the handlebar assembly is provided in FIG. 12. Handlebar 290 comprises three pieces, a center piece 294*a* and right and left pieces 293*a* and 295*a* (not shown in FIG. 12) which are coupled to center piece 294*a*, preferably by screwing or snapping thereto. Handle brackets 300 are attached at one end to handle bar center piece 294*a* and at an opposite end to an inner tube 330 by fastener 331.

It is especially preferred that center piece 294*a* have internally threaded ends which are configured for threaded engagement with complementary external threads on right and left pieces 293*a* and 295*a*. Center piece 294*a* also includes a pair of hubs 298 on each of its ends. Bracket apertures 301 are positioned on hubs 298 such that brackets 300 are fixed between right piece 293*a* and center piece 294*a* and between left piece 295*a* and center piece 294*a* when the right and left pieces are coupled to center piece 294*a*. Center piece 294*a* is inserted into foam grip 294, and right and left pieces 293*a* and 295*a* are inserted into foam grip pairs 292 and 293 and 295 and 296 and 296, respectively.

Figure 12:
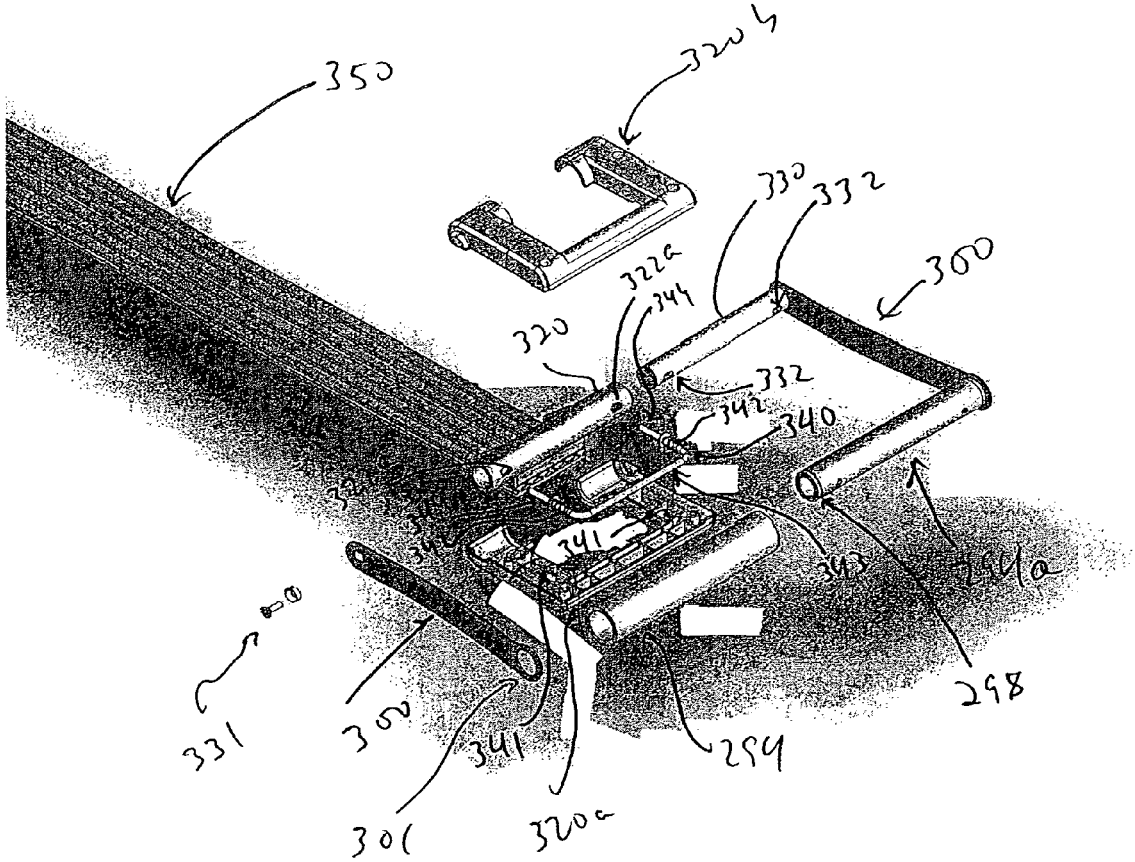
FIG. 12 is an exploded view of a portion of a handlebar assembly used in accordance with the present invention.

A hollow outer tube 320 is fixedly attached to an outer tube bracket 284 connected to the bottom surface of sliding engagement member 350. The outer tube 320 has three aperture pairs 322*a-c* (only one pair of which is shown in FIG. 12). The apertures comprising each pair are axially spaced apart from one another proximate opposite ends of outer tube 320. Each aperture pair 322*a-c* is spaced apart from the other pairs around the circumference of outer tube 320. The positions of the three aperture pairs 322*a-c* define the pre-selected rotational positions of the handlebar 290.

Again referring to FIG. 12, inner tube 320 is disposed in the hollow outer tube 320. Inner tube 320 contains a single pair of apertures 332 which are alignable with each of the aperture pairs 322*a-c* of outer tube 320. Inner tube 320 has a longitudinal axis which is the axis of rotation of handlebar 290.

Handlebar housing 320 comprises upper half 320*b* and lower half 320*a*, which are secured to one another, preferably by screws, so as to partially contain handle brackets 300, and the apertured portions of outer tube 320. A locking member 340, preferably a spring lock, is provided for releasable insertion through apertures 332 and aperture pairs 322*a-c*. Locking member 340 has a locking position and a release position. In the locking position, locking member 340 is inserted through apertures 332 and one of aperture pairs 322*a-c*. In the release position, it is withdrawn from apertures 332 and aperture pairs 322*a-c*. In the embodiment depicted in FIG. 12, locking member 340 has a c-shape with a pair of ends 344 connected by a center portion 343. Springs 342 are provided to bias locking member 340 in a locking position towards outer tube 320. Upper half 320*b* and lower half 320*a* of handlebar housing 320 each include complementary pairs of molded in spring retainer guides 341 for retaining locking member 340 and springs 340 within housing 320.

FIGS. 10, 10*a* and 11 show the handlebar assembly in its assembled state. Aperture pairs 322*a-c* define three rotational positions located at about 10 degrees below, 40 degrees above and 90 degrees above the plane defined by the lower surface of platform 110. To adjust the position of handlebar 290, the user grips center portion 343 of locking member 340 thereby pulling ends 344 out of inner tube aperture pair 332 and one of outer tube aperture pairs 322*a-c*. While gripping locking member 340, the user rotates handlebar 290, handle brackets 300, locking member 340, housing 310 and inner tube 330 about the longitudinal axis of inner tube 330. Because it is fixedly attached to the bottom of sliding engagement member 350, outer tube 320 remains stationary during this rotation. Once the user reaches the desired rotation corresponding to one pair of aperture pairs 322*a, b* or *c*, he releases locking member 340. The biasing action of springs 342 then inserts ends 344 through one of the aperture pairs 322*a, b* or *c* of outer tube 320 and through aperture pair 332 of inner tube 330, thereby locking the handlebar 290 into place at the desired rotational position.

The muscle stretching device of this embodiment is preferably designed to facilitate stretching with the hands positioned at multiple widths from one another on handlebar 290. Stretching at wider hand spacings focuses on the most lateral muscles, including the triceps, latissimus, and lateral rotator cuff muscles. Stretching at narrower hand spacings focuses on the spinal and para-spinal muscles of the lower cervical spine and the entire thoracic spine. Intermediate spacings focus on muscles lying between the foregoing positions along the posterior of the body, including the trapezius and the scapular muscles, as well as muscles located along the anterior of the body such as the pectoralis and the anterior chest muscles.

The muscle stretching device of this embodiment is more preferably designed to facilitate stretching with the hands placed at three widths from one another. Referring again to FIG. 10, handlebar 290 is provided with a plurality of foam segments 292-296. The foam segments allow the user to repeatably space his hands at fixed distances from the center of handlebar 290 when using the device, thereby providing for more consistent stretching and enhanced therapeutic effect. For example, the user can use foam segments 292 and 296 to position the hands for a wide stretch, foam segments 293 and 295 for an intermediate stretch, and foam segment 294 for a narrow stretch. The widths and positions of the foam segments 292-296 are preferably designed to focus the user's stretching on the three sets of muscle groups identified above for wider, narrower and intermediate hand spacings.

A preferred embodiment of a method for stretching muscles using the device of the second embodiment will now be described. According to this embodiment, the user first adjusts handlebar 290 to the desired rotational position as described above. If more strenuous stretching is desired, handlebar 290 is rotated below the plane defined by the lower surface of platform 110. Referring to FIG. 1, this corresponds to a counterclockwise rotation of handlebar 290. If less strenuous exercise is desired, handlebar 290 is rotated above the plane. The user then lies on platform 110 with her head positioned in first section 112 and her feet located at the opposite end in second section 116. The user's shoulders should be positioned at concave transition section 114 such that they can roll back and dip below the plane of the top surface of platform 110 when extending handlebar 290. As with the embodiment of the method described previously, the user flexes her knees to her chest and positions her feet directly below her buttocks to take the forward lumbar curve out of the lower back.

The user then grips the foam segments 292-296 to obtain the desired spacing of the hands with respect to the center of handlebar 290. For easier stretching, the outermost foam segments 292 and 296 are gripped. For the most difficult stretching, center foam segment 294 is gripped with both hands. It is especially preferred that the user perform three sets of progressively more strenuous stretches, starting from the outside of handlebar 290 and working inward. The particular muscles that are targeted by using the various positions defined by foam segments 292-296 on handlebar 290 are described above.

While gripping handlebar 290, the user extends her arms away from platform 110 until fully extended and preferably holds them in the fully extended position for at least 60 seconds. She then retracts her arms to the starting position. It is especially preferred to hold the stretch for at least 60 seconds at each of the three hand spacings defined by foam segments 292-296.

The user can optionally add additional resistance to the stretching device of the second embodiment by attaching a resistance increasing device such as a stretchable band, an elongated spring or a bungee cord to it. As shown in FIGS. 11 and 13, two-cross bars 440*a* (not visible in FIG. 11) and 440*b* are preferably provided and attached to sidewalls 420 of frame 410. The user can attach the ends of such a resistance increasing device to one of the cross-bars 440*a* and 440*b* and to mounting bar 353 which is secured to the bottom of glide 350 proximate handlebar housing 310. In addition, the user can wrap a resistance increasing device around cross-bar 440*a* or 440*b* and attach both ends of the resistance increasing device to mounting bar 353. It is especially preferred to connect a linear resistance spring to mounting bar 353 and cross-bar 440*b*. If further increased resistance is desired, it is particularly preferred to wrap a linear resistance spring around cross-bar 440*a* and connect both ends of the spring to mounting bar 353.

The device and method described above stretches the chest muscles, tightens the mid back muscles, lifts the chest and pulls the shoulders up and back. The result is preferably improved posture. By straightening the posture, the head is balanced over the shoulders, as it should be and thereby taking all the aggravating stress of the neck and upper back muscles away from the person.

The embodiments described above are exemplary embodiments of the present invention. Those skilled in the art may now make numerous uses of, and departures from, the above-described embodiments without departing from the inventive concepts disclosed herein. Accordingly, the present invention is to be defined solely by the scope of the following claims.

What is claimed is:

1. A muscle stretching device, comprising:

a. a platform assembly, comprising a base assembly and a platform mounted to the base assembly, said platform comprising a first section, a second section, and a concave transition between said first and second sections; and b. a handlebar operatively connected to said platform assembly, wherein said platform has a surface defining a plane, and wherein said handlebar is adapted to rotate below said plane.

2. The muscle stretching device of claim 1, wherein said handlebar has a first position proximate said platform and a second position distal from said platform.

3. The muscle stretching device of claim 1, wherein said handlebar is adapted for sliding movement with respect to said platform assembly.

4. The muscle stretching device of claim 3, wherein said platform comprises a surface defining a plane, and wherein said sliding movement is in a direction parallel to said plane.

5. The muscle stretching device of claim 1, wherein said platform assembly further comprises a guide assembly, and said handlebar assembly slidingly engages said guide assembly.

6. The muscle stretching device of claim 5, further comprising a sliding engagement member connected to said handlebar, wherein said sliding engagement member slidingly engages said guide assembly.

7. The muscle stretching device of claim 1, wherein said platform has a surface defining a plane, and wherein said handlebar is adapted to rotate above said plane.

8. The muscle stretching device of claim 1, wherein said handlebar is adapted to rotate above and below said plane.

9. The muscle stretching device of claim 1, wherein said handlebar is adapted to rotate to a plurality of pre-selected positions with respect to said plane.

10. The muscle stretching device of claim 9, wherein one of said pre-selected positions is about 90 degrees above said plane.

11. The muscle stretching device of claim 9, wherein one of said pre-selected positions is about 40 degrees above said plane.

12. The muscle stretching device of claim 9, wherein one of said pre-selected positions is about 10 degrees below said plane.

13. The muscle stretching device of claim 1, wherein said platform assembly has a compact position and an expanded position.

14. The muscle stretching device of claim 5, wherein said guide assembly comprises a frame having a pair of sidewalls and at least one roller assembly attached to each said pair of sidewalls.

15. The muscle stretching device of claim 14, wherein each said roller assembly comprises at least one roller mounted on a roller shaft, said roller shaft having a pair of ends, wherein each said end is connected to one of said sidewalls, and wherein each said roller is rotatable about said roller shaft.

16. The muscle stretching device of claim 6, wherein said sliding engagement member further comprises a restraining piece for restraining the movement of said sliding engagement member with respect to said platform assembly.

17. A muscle stretching device, comprising:

a. a platform assembly, comprising a base assembly and a platform mounted to the base assembly, said platform comprising a first section, a second section, a concave transition between said first and second sections, and a guide assembly;

b. a handlebar operatively connected to said platform assembly; and c. a sliding engagement member connected to said handlebar, wherein said sliding engagement member slidingly engages said guide assembly, wherein said sliding engagement member includes a restraining piece for restraining the movement of said sliding engagement member with respect to said platform assembly, and wherein said restraining piece is a rectangular block.

18. A muscle stretching device, comprising:

a. a platform assembly, comprising a base assembly and a platform mounted to the base assembly, said platform comprising a first section, a second section, and a concave transition between said first and second sections; and b. a handlebar operatively connected to said platform assembly and further comprising a handlebar restraint.

19. The muscle stretching device of claim 18, wherein said handlebar restraint comprises at least one rectangular block attached to said platform.

20. A muscle stretching device, comprising:

a. a platform assembly comprising a base assembly, a platform mounted to the base assembly, and a frame attached to said platform, said platform comprising a first section, a second section, and a concave transition between said first and second sections, said base assembly comprising a pair of legs pivotally connected to said platform and a pair of arms, each said arm having first and second arm ends;

wherein said first arm end is adapted for sliding engagement along one of said legs and said second arm is pivotally connected to said frame; and b. a handlebar, operatively connected to said platform assembly.

21. The muscle stretching device of claim 20, wherein said platform and said pair of legs define an angle ranging from about 0 to 20 degrees.

22. The muscle stretching device of claim 20, wherein said platform and said pair of legs define an angle ranging from about 5 to 15 degrees.

23. The muscle stretching device of claim 20, wherein said platform and said pair of legs define an angle ranging from about 8 to 10 degrees.

24. The muscle stretching device of claim 20, wherein said platform and said pair of legs define an adjustable angle.

25. The muscle stretching device of claim 24, wherein said adjustable angle ranges from about 0 degrees to 20 degrees.

26. The muscle stretching device of claim 24, wherein said adjustable angle ranges from about 0 degrees to 15 degrees.

27. The muscle stretching device of claim 24, wherein said adjustable angle ranges from about 0 to 10 degrees.

28. A muscle stretching device, comprising:

a. a platform mounted to a base, said platform having a surface defining a plane; and b. a handlebar operatively connected to said platform and adapted for sliding movement away from said platform in a direction parallel to said plane, said handlebar being adapted to rotate below said plane.

29. The muscle stretching device of claim 28, wherein said handlebar has a first position proximate said platform and a second position distal from said platform.

30. The muscles stretching device of claim 28, wherein said handlebar is adapted to rotate above said plane.

31. The muscle stretching device of claim 28, wherein said handlebar is adapted to rotate above and below said plane.

32. The muscle stretching device of claim 28, wherein said handlebar is adapted to rotate to a plurality of pre-selected positions with respect to said plane.

33. The muscle stretching device of claim 32, wherein one of said pre-selected positions is about 90 degrees above said plane.

34. The muscle stretching device of claim 32, wherein one of said pre-selected positions is about 40 degrees above said plane.

35. The muscle stretching device of claim 32, wherein one of said preselected positions is about 10 degrees below said plane.

36. The muscle stretching device of claim 32, wherein said plurality of pre-selected positions is three pre-selected positions.

37. A muscle stretching device, comprising:

a. a platform mounted to a base, said platform having a surface defining a plane; and b. a handlebar operatively connected to said platform and adapted for sliding movement away from said platform in a direction parallel to said plane, said handlebar being adapted to rotate with respect to said plane to a plurality of pre-selected positions, wherein said plurality of pre-selected positions comprises three positions at about 10 degrees below said plane, about 40 degrees above said plane, and about 90 degrees above said plane.

38. A muscle stretching device, comprising:

a. a platform mounted to a base, said platform having a surface defining a plane;

b. a handlebar operatively connected to said platform and adapted for sliding movement away from said platform in a direction parallel to said plane, said handlebar being adapted to rotate with respect to said plane; and c. at least one handle bracket and an inner tube, said at least one handle bracket having first and second ends, said handlebar being attached to said first end of said handle bracket and said inner tube being attached to said second end of said handle bracket, said inner tube comprising at least one inner tube aperture.

39. The muscle stretching device of claim 38, wherein said device further comprises a sliding engagement member and a hollow outer tube attached to said sliding engagement member, said hollow outer tube having an outer tube surface with at least one aperture defined therethrough, wherein said inner tube is disposed in said hollow tube such that said at least one aperture of said inner tube is alignable with said at least one aperture of said hollow outer tube by rotating said handlebar and said bracket about said outer tube.

40. The muscle stretching device of claim 28, further comprising a guide assembly, wherein said handlebar is adapted to slidingly engage said guide assembly.

41. The muscle stretching device of claim 40, further comprising a sliding engagement member connected to said handlebar, wherein said sliding engagement member slidingly engages said guide assembly.

42. The muscle stretching device of claim 39, further comprising a housing, said bracket being secured to said housing, at least part of said outer tube being disposed within said housing such that said housing, said bracket and said handlebar rotate together about said outer tube.

43. The muscle stretching device of claim 42, wherein said device further comprises a locking member that is attached to said housing and rotatable therewith, said locking member having a locking position and a release position.

44. The muscle stretching device of claim 43, wherein in said locking position, said locking member is inserted through said at least one aperture of said inner tube and said at least one aperture of said outer tube, thereby restraining said handlebar from rotation about said outer tube.

45. The muscle stretching device of claim 44, further comprising a biasing spring adapted to bias said locking member towards said outer tube.

46. The muscle stretching device of claim 28, wherein said handlebar includes a plurality of handlebar grips.

47. The muscle stretching device of claim 46, wherein said handlebar grips comprise a foam material.

48. The muscle stretching device of claim 39, wherein said at least one aperture of said outer tube comprises a pair of apertures.

49. The muscle stretching device of claim 39, wherein said at least one aperture of said outer tube comprises three pairs of apertures.

50. A muscle stretching device, comprising:

a. a platform assembly, including a platform having first and second ends, a frame, and a base assembly, wherein at least a portion of said frame is connected to said platform proximate said first end of said platform, and wherein said base assembly comprises at least a pair of legs, at least two of said legs being pivotally connected to said platform proximate said second end of said platform, said base assembly further comprising at least a pair of arms, at least two of said arms having a first arm end engaged with a corresponding one of said legs and movable along the length of said corresponding one of said legs, at least two of said arms having a second arm end pivotally connected to said frame proximate said first end of said platform; and b. a handlebar, operatively connected to said platform assembly proximate said first end of said platform.

51. The muscle stretching device of claim 50, wherein said platform and said pair of legs define an angle ranging from about 0 to 20 degrees.

52. The muscle stretching device of claim 50, wherein said platform and said pair of legs define an angle ranging from about 5 to 15 degrees.

53. The muscle stretching device of claim 50, wherein said platform and said pair of legs define an angle ranging from about 8 to 10 degrees.

54. The muscle stretching device of claim 50, wherein said platform and said pair of legs define an adjustable angle ranging from about 0 to 20 degrees.

55. The muscle stretching device of claim 50, wherein said platform and said pair of legs define an adjustable angle ranging from about 0 to 15 degrees.

56. The muscle stretching device of claim 50, wherein said platform and said pair of legs define an adjustable angle ranging from about 0 degrees to 10 degrees.

57. The muscle stretching device of claim 50 wherein said platform assembly has a compact position and an expanded position.

58. The muscle stretching device of claim 57, wherein in said expanded position, said platform and said pair of legs define an angle of about 10 degrees.

59. The muscle stretching device of claim 50, wherein said base assembly further comprises a pair of bearing carriers, each said bearing carrier corresponding to one of said legs and one of said arms; each said bearing carrier having a body with an aperture, wherein each said leg is inserted through said aperture of said corresponding bearing carrier such that each said bearing carrier is movable along each said corresponding leg.

60. The muscle stretching device of claim 59, wherein each said bearing carrier further comprises a nipple projecting therefrom, each said second arm end has an aperture defined therethrough, and each said nipple is inserted through said aperture of said corresponding arm such that each said arm is rotatable about each said corresponding nipple.

61. The muscle stretching device of claim 60, wherein said base assembly further comprises a cross-member having a pair of ends, each said end being connected to a corresponding one of said bearing carrier nipples.

62. The muscle stretching device of claim 61, wherein said frame further includes a recessed portion adapted to receive said cross-member.

63. A muscle stretching device, comprising:

a. a platform assembly, comprising a platform mounted to a base assembly;

b. a guide assembly connected to said platform, said guide assembly including a frame, said frame having a pair of sidewalls, said guide assembly further including at least one roller assembly attached to each said sidewall; and c. a handlebar assembly connected to said platform assembly, said handlebar assembly including an extended position and a retracted position, a handlebar and a sliding engagement member connected to said handlebar, wherein said sliding engagement member slidingly engages said guide assembly, and wherein said guide assembly further comprises a handle bar restraint.

64. The muscle stretching device of claim 63, wherein said platform has an upper surface and a lower surface, and wherein said guide assembly is connected to said lower surface of said platform.

65. The muscle stretching device of claim 64, wherein said sliding engagement member slidingly engages said guide assembly between said at least one roller assembly and said lower surface of said platform.

66. The muscle stretching device of claim 63, wherein said at least one roller assembly comprises three roller assemblies.

67. The muscle stretching device of claim 63, wherein said sliding engagement member further comprises a restraining piece for restraining the movement of said sliding engagement member with respect to said platform assembly.

68. A muscle stretching device, comprising:

a. a platform assembly, comprising a platform mounted to a base assembly;

b. a guide assembly connected to said platform, said guide assembly including a frame, said frame having a pair of sidewalls, said guide assembly further including at least one roller assembly attached to each said sidewall; and c. a handlebar assembly connected to said platform assembly, said handlebar assembly including a handlebar and a sliding engagement member connected to said handlebar, wherein said sliding engagement member slidingly engages said guide assembly, wherein said sliding engagement member further comprises a restraining piece for restraining the movement of said sliding engagement member with respect to said platform assembly, and wherein said restraining piece comprises a rectangular block.

69. The muscle stretching device of claim 63, wherein when said handlebar assembly is in said extended position, said restraining piece abuts said handlebar restraint.

70. The muscle stretching device of claim 63, wherein said handlebar restraint comprises at least one rectangular block connected to said lower surface of said platform between said pair of sidewalls.

71. The muscle stretching device of claim 70, wherein said at least one rectangular block is two rectangular blocks.

72. A muscle stretching device, comprising:

a. a platform mounted to a base, said platform having a surface defining a plane;

b. a handlebar, operatively connected to said platform; and c. a means for rotating said handlebar below said plane.

73. The muscle stretching device of claim 72, wherein said means for rotating said handlebar assembly comprises a means for rotating said handlebar to a pre-selected number of positions with respect to said plane.

74. The muscle stretching device of claim 73, wherein said pre-selected number of positions is three.

75. The muscle stretching device of claim 72, further comprising a means for slidingly engaging said handlebar and said platform assembly.

76. A muscle stretching device, comprising:

a. a platform assembly, said platform assembly comprising a base assembly and a platform mounted to said base;

b. a handlebar, operatively connected to said platform assembly; and c. a means for slidably moving said handlebar with respect to said platform, wherein said means further comprises a handlebar restraint.

77. A muscle stretching device, comprising:

a. a platform assembly, comprising a base assembly and a platform mounted to said base assembly, said platform comprising a first section, a second section, and a concave transition between said first and second sections, said platform having upper and lower surfaces;

b. a guide assembly attached to said lower surface of said platform, said guide assembly comprising a frame having a pair of sidewalls and further comprising at least one roller assembly connected to said frame;

c. a handlebar assembly, connected to said platform assembly and adapted for sliding movement with respect to said platform assembly, said handlebar assembly comprising:

(i) a handlebar;

(ii) at least one handle bracket having first and second ends, said handlebar being attached to said first end of said handle bracket;

(iii) a sliding engagement member;

(iv) a hollow outer tube attached to said sliding engagement member, said outer tube having a longitudinal axis and having at least one aperture defined therethrough;

(v) an inner tube, disposed within said hollow outer tube and being attached to said second end of said handle bracket, said inner tube further comprising at least one aperture alignable with said at least one aperture of said outer tube;

(vi) a locking member, having a locking position and a release position, wherein in said locking position, said locking member is inserted through said at least one aperture of said inner tube and said at least one aperture of said outer tube, thereby restraining said handlebar from rotation about said longitudinal axis;

wherein said sliding engagement member slidingly engages said guide assembly between said pair of sidewalls and between said at least one roller assembly and said lower surface of said platform, and wherein said handlebar, said inner tube, and said locking member are rotatable about said longitudinal axis.

* * * * *